United States Patent [19]

Phalen

[11] Patent Number: 4,684,767

[45] **Date of Patent: * Aug. 4, 1987**

[54] TACTILE AFFIRMATIVE RESPONSE MEMBRANE SWITCH

[76] Inventor: Robert F. Phalen, 1612 W. North Ave., Chicago, Ill. 60622

[ * ] Notice: The portion of the term of this patent subsequent to Jul. 22, 2003 has been disclaimed.

[21] Appl. No.: 882,944

[22] Filed: Jul. 7, 1986

Related U.S. Application Data

[63] Continuation-in-part of Ser. No. 739,544, May 30, 1985, Pat. No. 4,602,135.

[51] Int. Cl.[4] ..... H01H 13/70

[52] U.S. Cl. ..... 200/5 A; 200/159 B; 200/308

[58] Field of Search ..... 200/5 A, 86 R, 159 B, 200/308, 292

[56] References Cited

U.S. PATENT DOCUMENTS

| | | | |
|---|---|---|---|
| 3,860,771 | 1/1975 | Lynn et al. | 200/5 A |
| 3,959,610 | 5/1976 | Finnegan et al. | 200/5 A |
| 4,066,850 | 1/1978 | Heys, Jr. | 200/5 A |
| 4,237,351 | 12/1980 | Boulanger et al. | 200/5 A |
| 4,423,294 | 12/1983 | Walser et al. | 200/5 A |
| 4,499,343 | 2/1985 | Prioux et al. | 200/5 A |
| 4,508,942 | 4/1985 | Inaba | 200/5 A |
| 4,602,135 | 7/1986 | Phalen | 200/159 B X |

*Primary Examiner*—J. R. Scott

*Attorney, Agent, or Firm*—Robert M. Ward

[57] ABSTRACT

The present invention is directed to an improved membrane switch of the kind comprising a polymeric overlay, which is generally planar and containing designated switch areas thereon for manual operation of pressure. The switch is formed from several layers of conductive and nonconductive materials. Specifically, the switch includes a pair of electronic switch circuit leads disposed in noncontacting proximity. A substantially planar circuit completing layer formed to corresponded with the pair of switch circuit leads is formed from conductive material and disposed and spaced array substantially parallel to the switch circuit leads. A nonconductive spacer is disposed, in one preferred embodiment, between the electric circuit and the circuit completing layer, with the spacer having a plurality of apertures therein of a selected density sufficient to provide a selected touch pressure. In another preferred embodiment, the substantially planar circuit completing layer is omitted, and the pair of electronic switch circuit leads are instead disposed in separate planes and are separated by the spacer, such that manual pressure on the switch will contact one circuit lead with the other circuit lead through the apertures in the spacer. Additionally another preferred embodiment includes the use of an improved actuator laminae including a top sheet having distinct dome-shaped portions which provide affirmative and detectable tactile responses.

15 Claims, 14 Drawing Figures

TACTILE AFFIRMATIVE RESPONSE MEMBRANE SWITCH

BACKGROUND OF THE INVENTION

This application is a continuation-in-part of Ser. No. 739,544 filed on May 30, 1985 now U.S. Pat. No. 4,602,135.

The present invention relates generally to switches and more particularly to an improved tacticle affirmative response switch combining the beneficial features of a membrane switch.

In regard to membrane switches of the prior art, various types of membrane switches have been utilized on machinery panels, calculators, computers, etc. Such membrane switches have the advantage over other forms of switches that they present a substantially flat upper surface, and are relatively very thin as compared with mechanical switches. Also, such membrane switches are enclosed, and contain very few moving parts. Accordingly, such membrane switches have had exceedingly long useful lives.

One difficulty with prior art membrane switches has been the inability to control selectively the amount of pressure necessary to operate this type of switch. Also, another difficulty with prior art switches has been frequently the necessity for switches requiring different manual pressures on the same or different switch panels. Also, the prior switches have had the further difficulty of an inability to provide different operating pressures within the same switch.

In regard to such prior art membrane switches, it has also been non-feasible to utilize affirmative tactile means to indicate to the operator that the switch has been actuated. In particular, it has not been feasible to emboss an overlay layer and use it as an activating means on conventional, prior art membrane switches, because of the prevalence of false actuations. Such false actuations have occurred because of the inability to control actuation pressure in such prior art membrane switches -- a problem which is particularly solved by certain domed embodiments of the present invention.

Thus, in view of the difficulties and deficiencies associated with prior art dome and membrane switches, it is an object of the improved switches of the present application to materially alleviate such difficulties and deficiencies.

SUMMARY OF THE INVENTION

The improved membrane switch of the present invention concerns switches having a top sheet with portions designated thereon for manual pushing to operate the switch.

The improved membrane switch of the present invention comprises a pair of electronic switch circuit leads which are disposed in noncontacting and mutually relative proximity. A substantially planar circuit completing means, the size and shape corresponding with at least a portion of the electronic switch circuit leads, is formed from a conductive material and is disposed in spaced array and substantially parallel to the switch circuits.

A circuit spacer means of a nonconductive material is disposed between the pair of electronic circuit leads and the circuit completing means. The circuit spacer means has a plurality of apertures therein of a selected density sufficient to provide a selected touch pressure for pushing portions of the circuit completing means which appear through apertures in the circuit spacer into contact with portions of the pair of electronic switch circuit leads to complete the circuit and to operate the switch.

In an alternative preferred embodiment, the electronic switch circuit leads are disposed in separate planes and substantially parallel to each other and are separated by the circuit spacer means. In such embodiment, the electronic circuit leads are disposed opposite each other, such that sufficient manual pressure on the switch disposes the electronic switch leads into contact with each other through the apertures in the circuit spacer means to operate the switch. In this embodiment also, the density and location of the apertures control the amount of pressure necessary to operate the switch.

In both of the above embodiments, the manual pressure necessary to operate the switch may be varied in switches on the same switch panel, or even in portions of the same discrete membrane switch, by varying the size and density of the apertures in the circuit spacer means.

In other preferred embodiments of the present invention involving tactile affirmative response switches (sometimes referred to as "domed" switches), the top sheet is embossed into the shape of an upwardly disposed dome in order to provide a tactile affirmative response to the switch. In such switches, the operator can feel the actuation of the switch in order to assure that the switch has in fact been operated. Where such a dome is utilized, it has been necessary in preferred embodiments to provide a top sheet spacer means between the embossed top sheet and the underlying portions of the electronic switch for optional functioning.

In other preferred embodiments of the improved tactile affirmative response switch of the present invention a substantially planar overlay sheet is disposed atop the top sheet, with the overlay sheet including manual pad portions embossed upwardly to extend over the dome portions of the top sheet. Such manual pad portions may be made larger than the underlying dome actuation portion, which provides an enlarged upper surface for manual contact, while at the same time providing an underlying functional dome of sufficiently small size to operate mechanically and permitting the manual pad portion to have a shape more suitable for manual pushing, while at the same time being sufficient to actuate the dome structure disposed therebeneath.

The improved membrane switch of the present invention will be better understood with reference to the following brief description of the drawing, detailed description of preferred embodiments, the appended claims, and the accompanying drawing.

BRIEF DESCRIPTION OF THE DRAWING

Various preferred embodiments of the improved membrane switch apparatus of the present invention are set forth in the accompanying drawing, and in which.

DETAILED DESCRIPTION OF THE PREFERRED EMBODIMENTS

Figure 1:
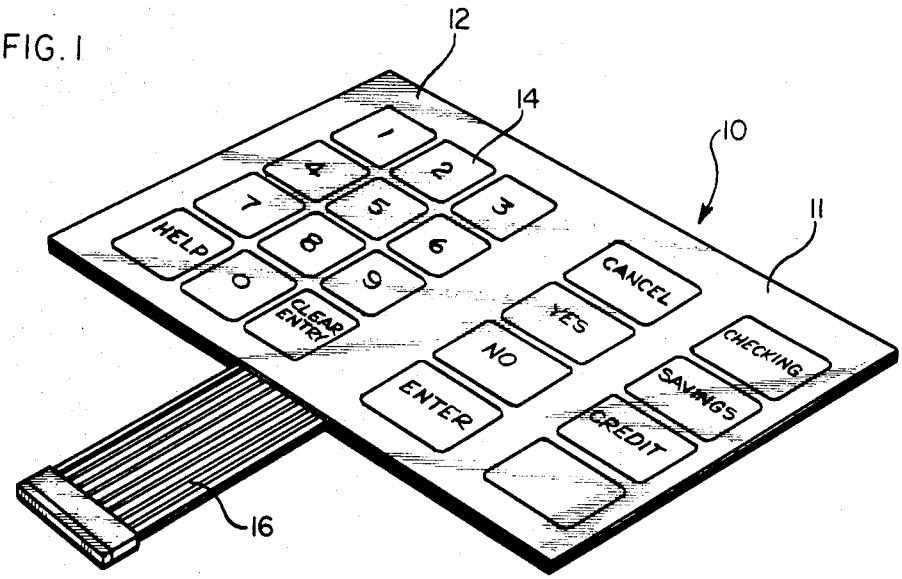
FIG. 1 is a perspective view of an exemplary membrane switch panel setting forth discrete areas containing visual indicia for disignating and defining portions of the panel to receive manual pressure for operating an electronic membrane switch disposed therebeneath.
Figure 2:
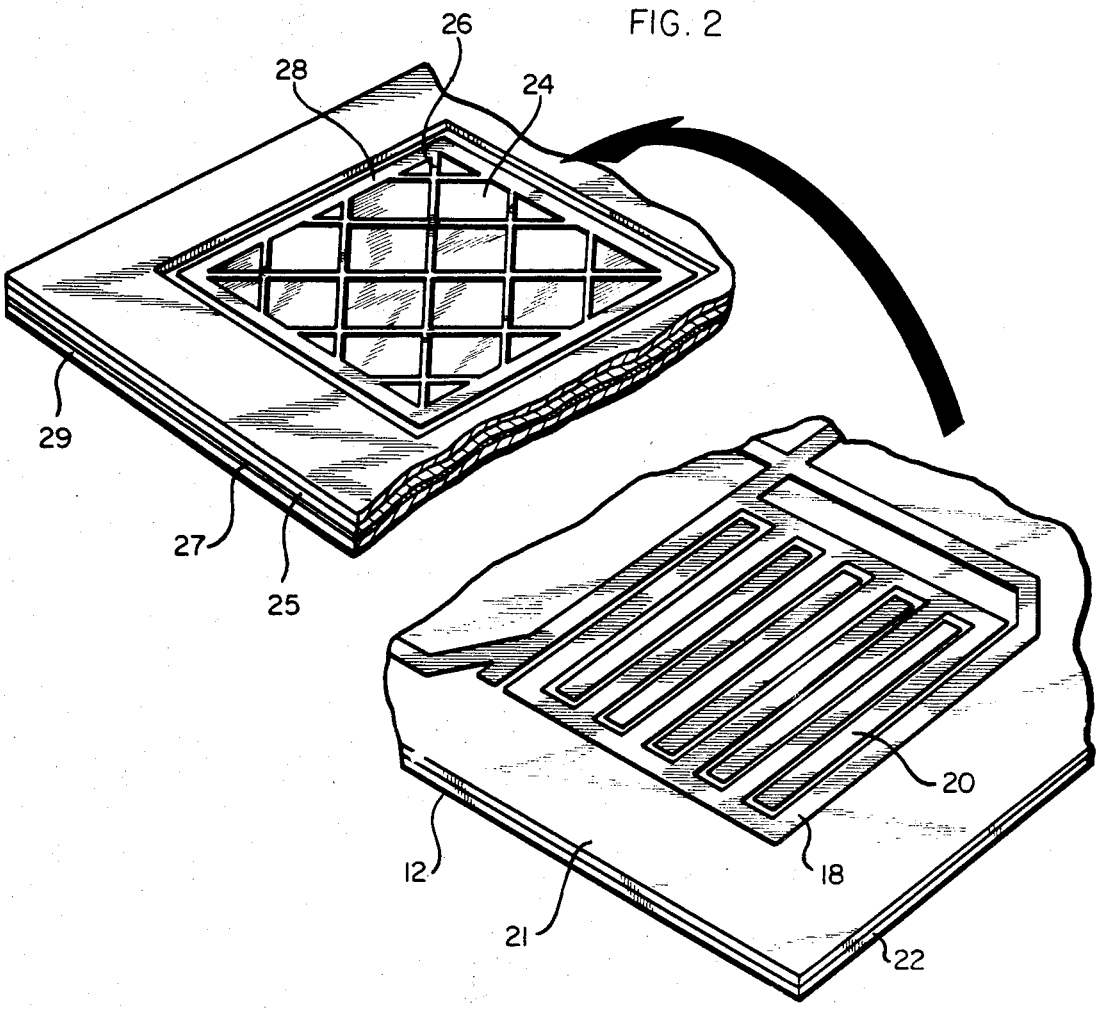
FIG. 2 is a greatly enlarged, fragmented view of the improved membrane switch of the present invention, shown in peeled-apart array, and illustrating the intertwining, but noncontacting, electronic switch circuit leads, and the facing nonconductive, grid-like circuit spacer means disposed atop the substantially planar circuit completing means formed from a conductive material.
Figure 3:
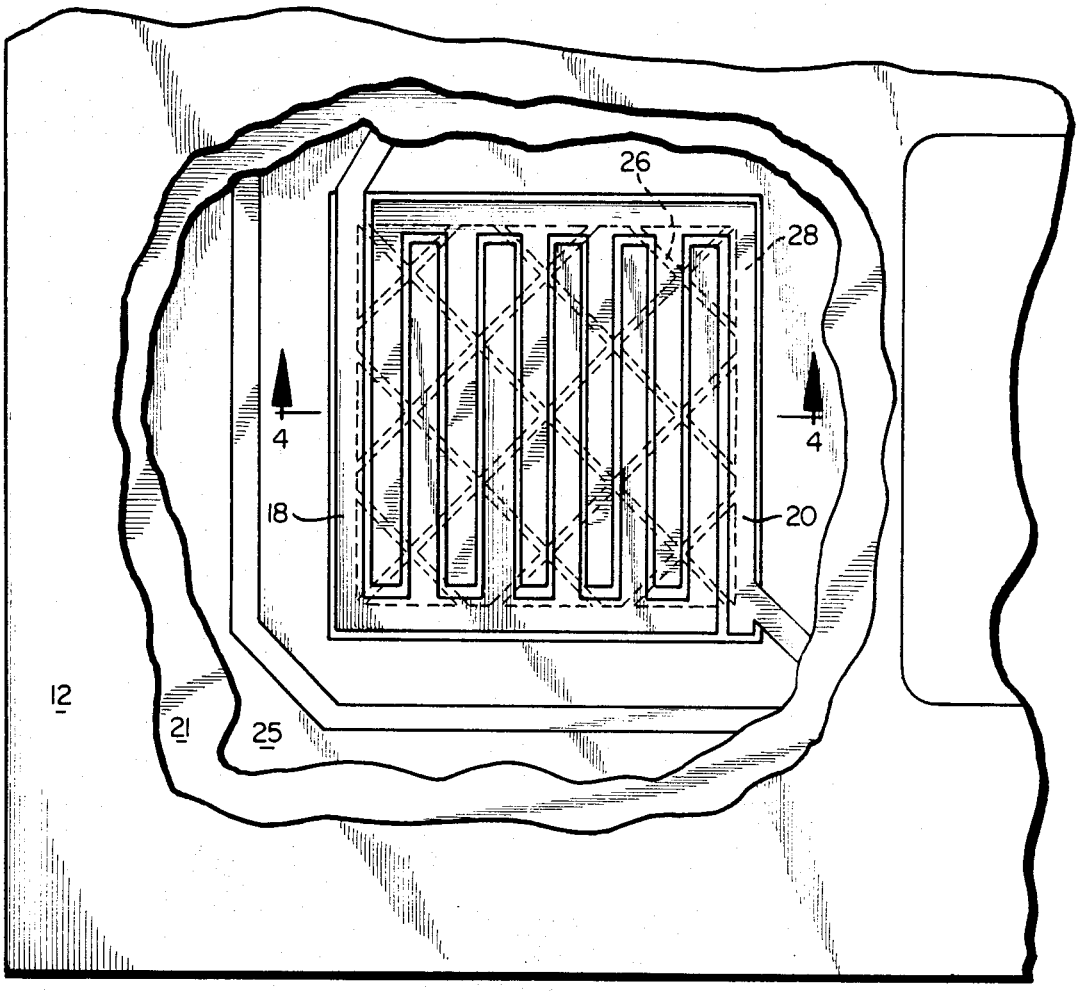
FIG. 3 is a greatly enlarged top view of the improved membrane switch of the present invention, with layers of the electronic panel cut away to illustrate the disposition of circuit completing means, and circuit spacer means (in phantom) disposed atop the pair of electronic switch circuit leads.
Figure 4:
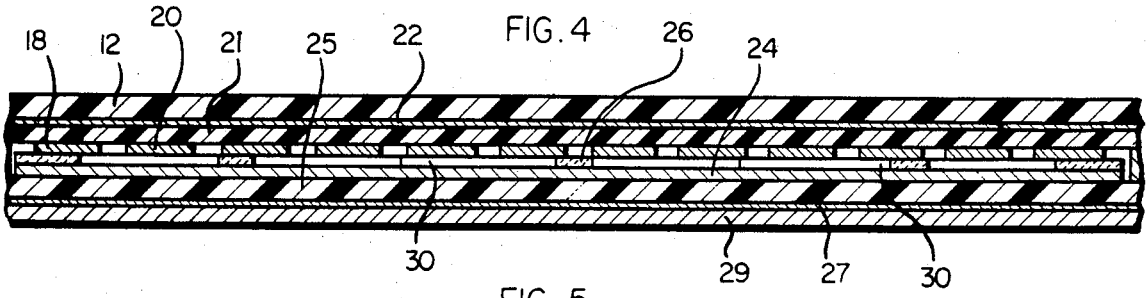
FIG. 4 is an even further enlarged, fragmented side view taken along lines 4—4 of FIG. 3, and illustrating the various layers comprising the improved membrane switch of the present invention.

The improved membrane switch of the present invention has a top sheet with portions designated by visual indicia thereon for manual pushing to operate the switch. The improved membrane switch of the present invention includes a pair of electronic switch circuit leads which are disposed in noncontacting, and mutually relative proximity. A substantially planar circuit completing means has a size and shape to correspond with at least a portion of the pair of switch circuit leads. Such circuit completing means is formed from a conductive material, and is disposed in spaced array and substantially parallel to the switch circuits. A circuit spacer means of a nonconductive material is disposed between the pair of electronic circuit leads and the circuit completing means. The circuit spacer means has a plurality of apertures therein of a selected density sufficient to provide a selective touch pressure for pushing portions of the circuit completing means appearing through the apertures and the circuit spacer into contact with portions of the pair of electronic switch circuit leads to complete the circuit and to operate the switch.

The improved membrane switch of the present invention also may include as and for the circuit spacer means a grid formed from lines of a nonconductive material. Such nonconductive material preferably comprises a nonconductive paint, which is disposed on the circuit completing means. Such circuit completing means preferably comprises a conductive paint material, and such conductive paint material is preferably disposed upon a backing sheet.

The nonconductive circuit spacer apertures may be selected for varying density in different portions of the nonconductive circuit spacer, to provide a variable touch pressure at different portions of the nonconductive circuit spacer. The pair of electronic switch circuit leads is preferably disposed in a common plane in preferred embodiments.

In other preferred embodiments, the electronic switch circuit leads are disposed in separate planes, and are disposed substantially parallel to each other and are separated by the circuit spacer means. In this preferred alternative embodiment, the electronic switch circuit leads are disposed opposite each other, whereby sufficient manual pressure on the switch disposes the electronic switch leads into contact through the apertures in the circuit spacer means to operate the switch.

In either of the above embodiments of the improved membrane switch of the present invention, the electronic switch circuits may be preferably formed by printing. Also, the top sheet as for the switch panel comprises a nonconductive polymeric overlay containing visual indicia thereon to define the switch area to be operated by manual pressure.

Other preferred embodiments of the present invention are directed to tactile affirmative response switches. These embodiments include at least one additional element. Specifically, in one preferred embodiment, the top sheet has a portion thereof including an upwardly disposed dome shaped embossment which is operable between two positions. In particular, such dome may be manually pushed downwardly, with a "snap", which provides a tactile response to the operator to assure the operator that the switch has operated. Thereafter, the dome automatically "snaps" back upwardly into the first position. In this embodiment, it is necessary to have a top sheet spacer means disposed between the top sheet and the supporting means for the underlying elements of the switch, and including an opening therein at the location of the dome-shaped portion of the top sheet.

In further preferred embodiments of the present invention, a yet additional element is also included, which is a planar overlay sheet disposed atop the top sheet of the switch of the above described tactile embodiments. This planar overlay sheet includes manual pad portions embossed upwardly to extend over the dome-shaped portions of the top sheet. In operation, when the planar overlay sheet is engaged by the finger of the operator and pushed downwardly, it engages the dome-shaped portion of the top sheet to provide a tactile response thereto. The reason for including such additional element of the overlay is that it permits a larger switch to be used for ease of engagement by the finger of the operator, while at the same time permitting a sufficiently small dome to be utilized for accurate and effective operation of the switch. Also, it is sometimes desirable for manual engagement to have a shape other than round or oval, but the round and oval shapes are the most effective shapes for a dome for actuating a switch.

Referring now to the drawing and to FIG. 1 in particular, the improved membrane switch of the present invention generally 10 is contained within a switch panel 11 has a top sheet 12 with switch portions 14 designated by visual indicia thereon for manual pushing to operate the switch 10. Such switch panel 11 may have an electronic connecting means in the form preferably of a flexible tail 16.

As shown in FIGS. 2–5, the improved membrane switch 10 of the present invention includes a pair of electronic switch circuit leads 18, 20 which are disposed in noncontacting, and mutually relative proximity. Such switch leads 18, 20 are disposed onto a polymeric sheet 21, which is in turn secured preferably by a contact adhesive 22 to top sheet 12, which contains the visual indicia.

A substantially planar circuit completing means 24 has a size and shape to correspond with at least a portion of the pair of switch circuit leads 22. Such circuit completing means 18, 20 is formed from a conductive material, and is disposed in spaced array and substantially parallel to the switch circuit completing means 24, as shown in the above Figures. The circuit completing means 18, 20 is disposed on a polymeric sheet 25, which is backed by adhesive 27, which in turn is protected by a peel strip 29 until applied for use to a control panel, etc.

Figure 5:
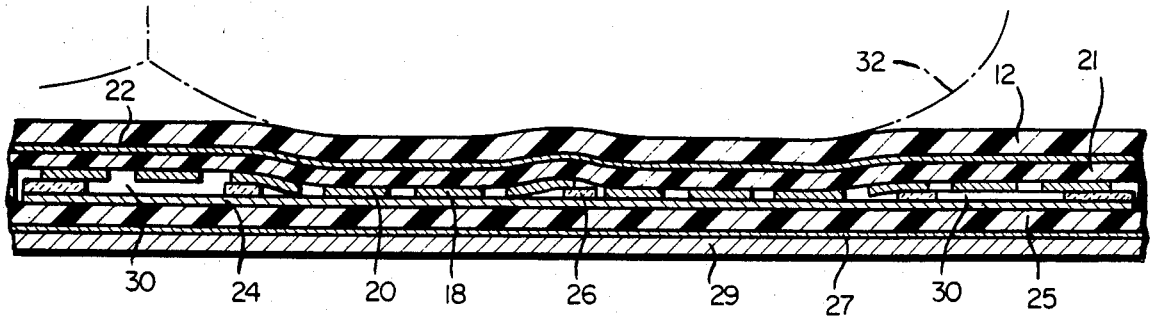
FIG. 5 is the view of the present invention as shown in FIG. 4 showing manual pressure being applied thereto to operate the switch.

A circuit spacer means 26 of a nonconductive material is disposed between the pair of electronic circuit leads 18, 20 and the circuit completing means 24. Such circuit spacer means 26 may also preferably include a nonconductive border portion 28. The circuit spacer means 26 has a plurality of apertures 30 therein of a selected density sufficient to provide a selective touch pressure for pushing portions of the circuit completing means 24 appearing through the apertures 30 of the circuit spacer means 26 into contact with portions of the pair of electronic switch circuit leads 18, 20 to complete the circuit and to operate switch 10, as shown in FIG. 5 by manual digit 32 shown in phantom lines.

The improved membrane switch of the present invention 10 may specifically include as and for the circuit spacer means 26 a grid formed from lines of a nonconductive material, as shown in the Figures hereof. Of course, circuit spacer means 26 may take shapes and forms other than a grid. Such nononductive material for circuit spacer means 26 preferably comprises a nonconductive paint, which is disposed on the circuit completing means. Such circuit completing means preferably comprises a conductive paint material.

Figure 8:
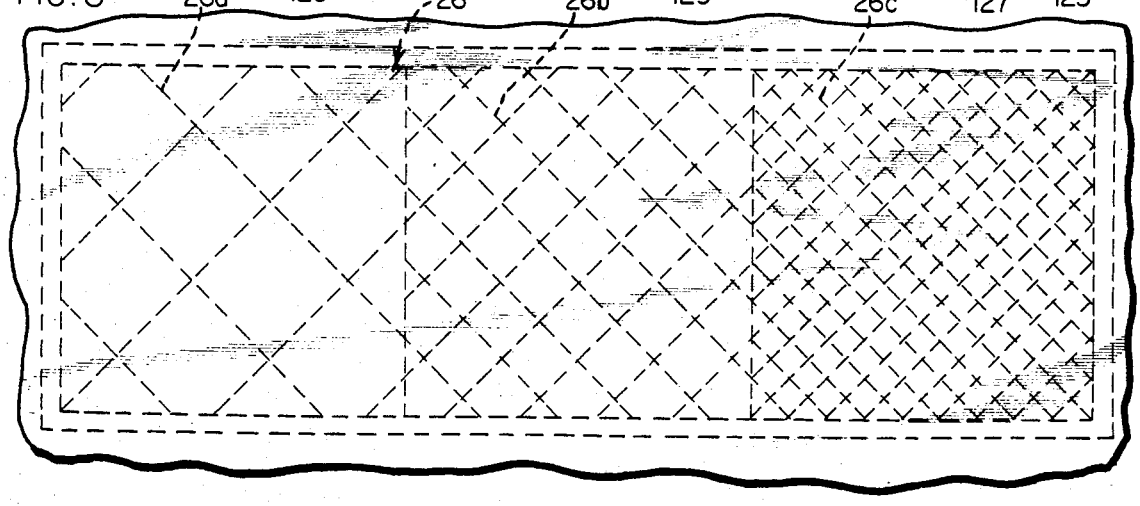
FIG. 8 is a greatly enlarged, and fragmentary top view of the circuit spacer means layer of the improved membrane switch of the present invention illustrating different densities of the grid-like spacer means, which can be utilized in different individual switches, or which may be utilized in different portions of the same switch.

The apertures 30 in circuit spacer means 26 may be selected to have varying density and to be disposed in different portions of the nonconductive circuit spacer means 26, to provide a variable touch pressure at different portions of the nonconductive circuit spacer means 26, as shown for example in FIG. 8. Therein, circuit spacer means generally 26 contains in left-hand portion relatively fewer grid lines **26*a* for lower pressure actuation, the middle portion contains a medium number of grid lines 26*b* for moderate pressure actuation, and the right-hand portion contains a dense number of grid lines 26*c*** for high pressure actuation.

Figure 6:
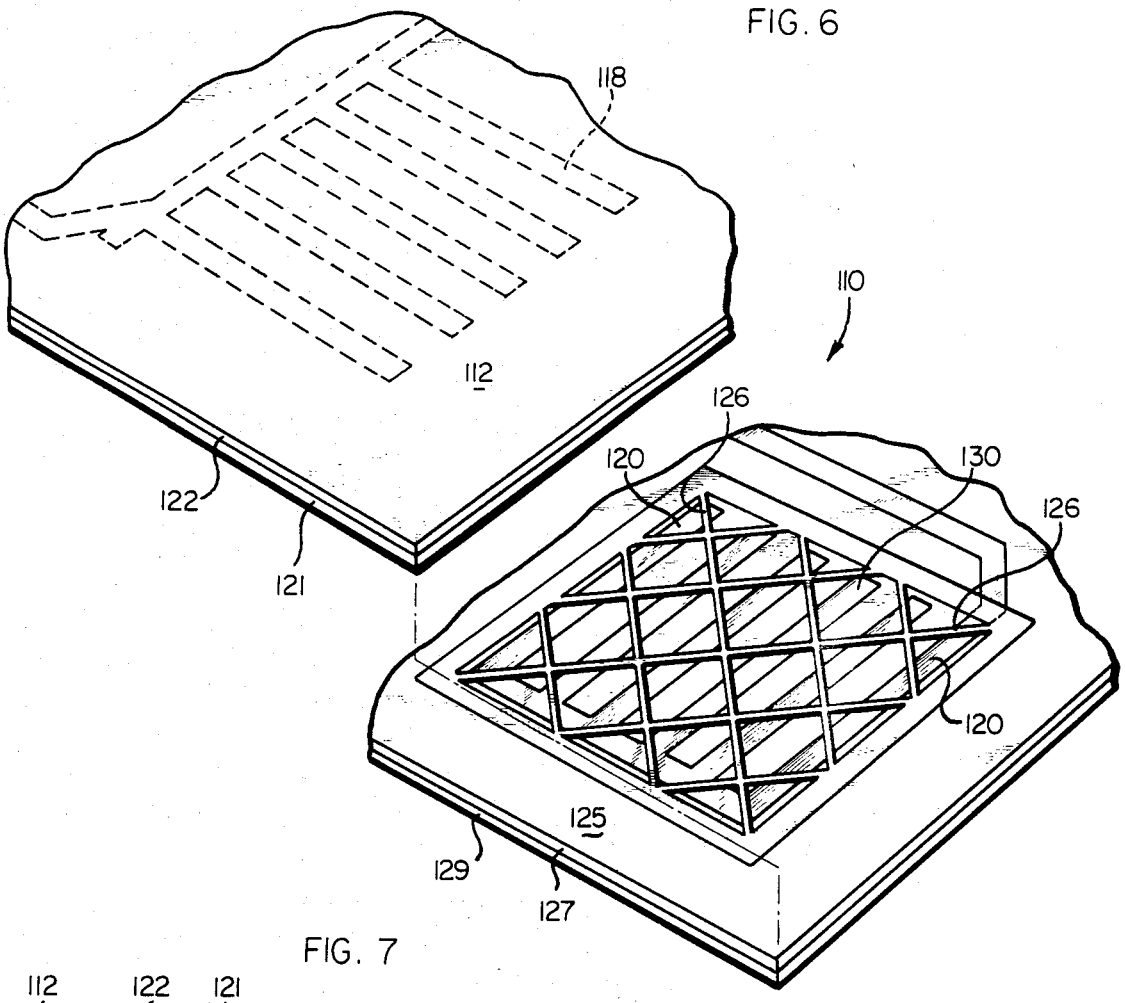
FIG. 6 is an enlarged fragmentary view of an alternative preferred embodiment of the improved membrane switch of the present invention illustrating the electronic switch circuit leads being disposed in separate planes, with the grid-like circuit spacer means of nonconductive material disposed therebetween, such that manual pressure on the switch will contact one electronic lead with the other, and through the apertures in the grid of the circuit spacer means to operate the switch.
Figure 7:
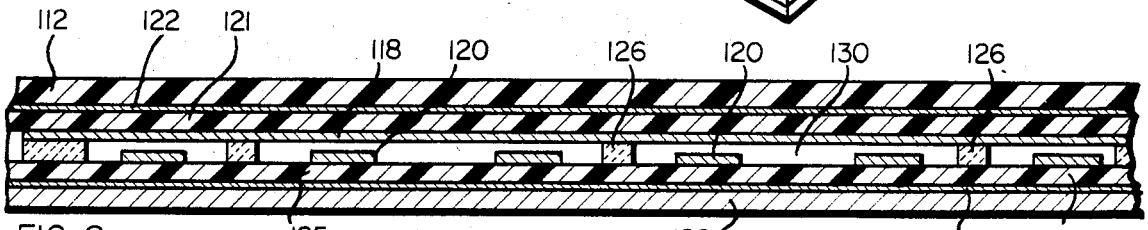
FIG. 7 is a greatly enlarged, and fragmented side view of the alternative preferred embodiment of the improved membrane switch of FIG. 6.
Figure 12:
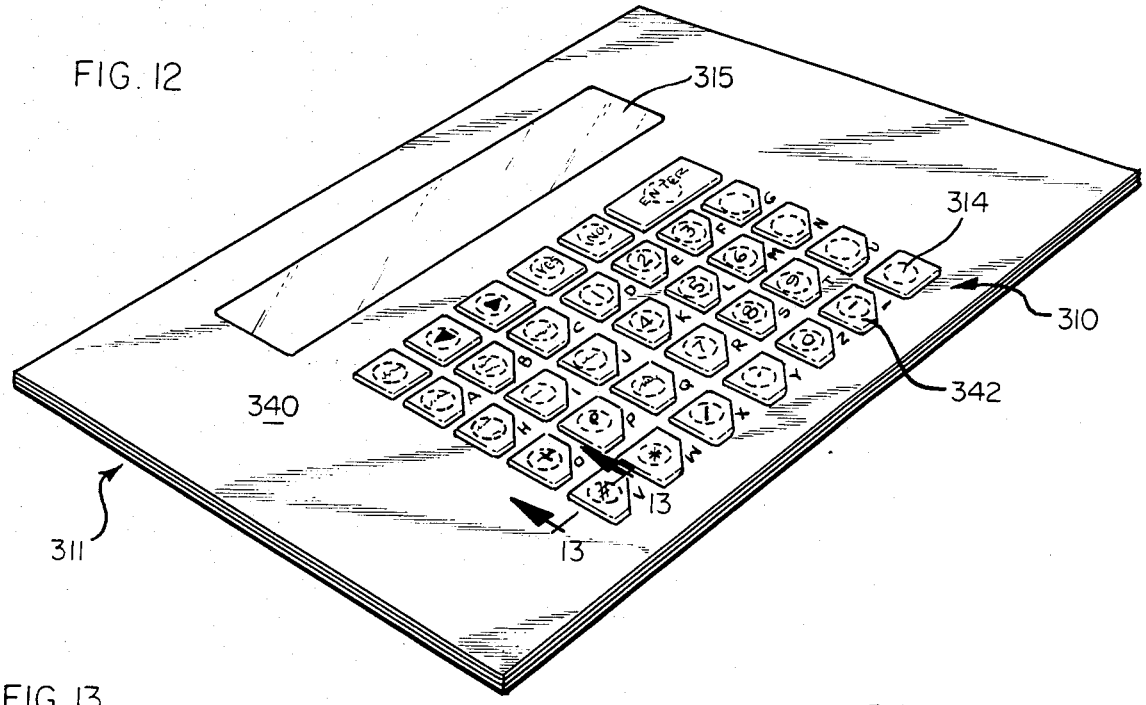
FIG. 12 is a perspective view of a switch keyboard showing a plurality of the improved tactile affirmative response switches of the present invention as set forth in keyboard format, and further showing a visual display area disposed at the top portion of such keyboard as also shown in FIG. 9, and including further a planar overlay sheet embossed with enlarged key shaped portions thereon.
Figure 13:
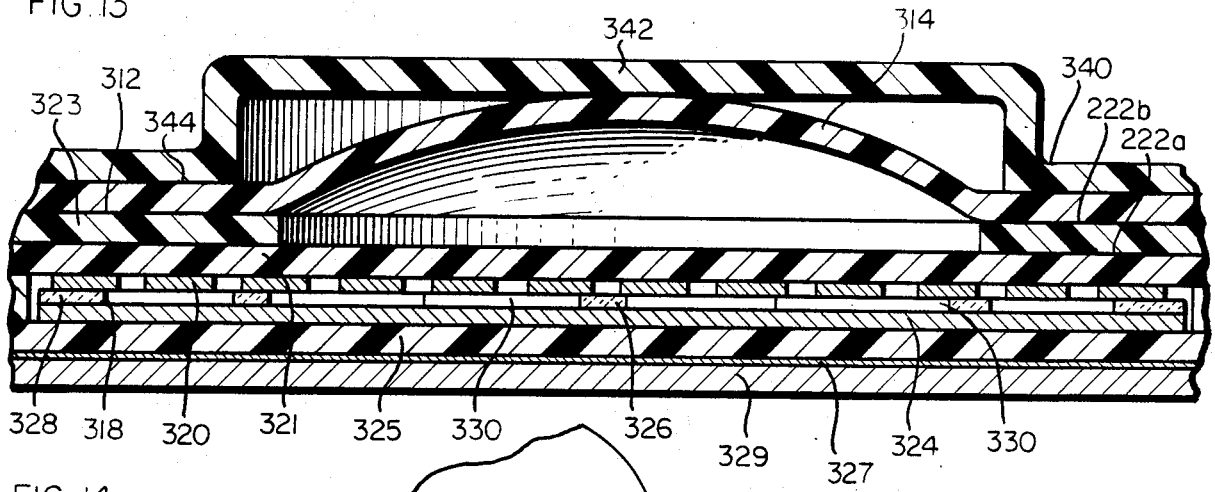
FIG. 13 is a greatly enlarged cross-sectional view of the improved tactile affirmative response of the present invention taken along lines 13—13 of FIG. 12, and showing in particular the upwardly disposed dome shaped manually operable portion of the top sheet, disposed atop a spacer sheet, which in turn is disposed above the remaining elements of the switch, as described in the figures, supra, and including further a planar overlay sheet disposed atop the top sheet.
Figure 14:
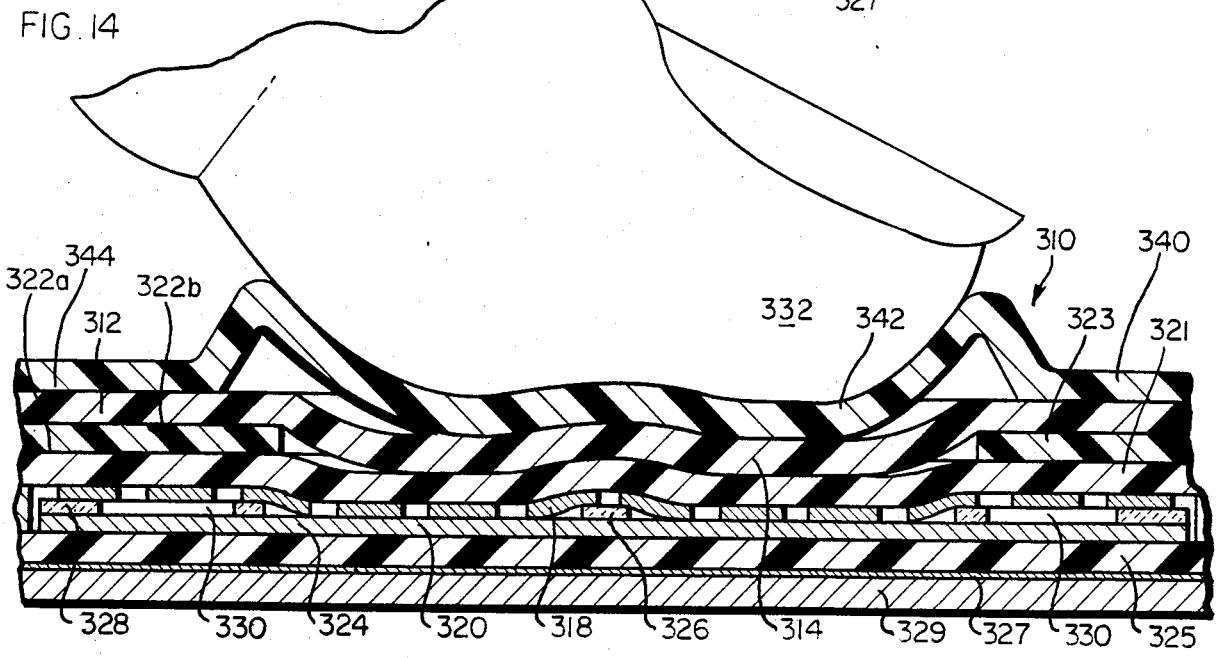
FIG. 14 is also a greatly enlarged sectional view of the embodiment of the present invention as shown in FIG. 13, being actuated by manual pressure.

In other preferred embodiments as shown in FIGS. 6–7 and generally designated as switch 110, the electronic switch circuit leads 118, 120 are disposed in separate planes, are disposed substantially parallel to each other and are separated by the circuit spacer means 126. The remaining elements of switch 110 are analogous to those of the embodiment of switch 10, of FIGS. 2–5, and like elements are usually designated with like numerals plus 100. Similarly, in FIGS. 9–11 common elements are given corresponding numerals in the 200 series of number, while common elements in the embodiments of FIGS. 12–14 are given corresponding numerals in the 300 series.

In the preferred alternative embodiment 110, the electronic switch circuit leads 118, 120 are disposed opposite each other and preferably at 90° to each other, whereby sufficient manual pressure on the switch disposes the electronic switch leads 118, 120 into contact through the apertures 130 in circuit spacer means 126 to operate the switch 110.

Figure 9:
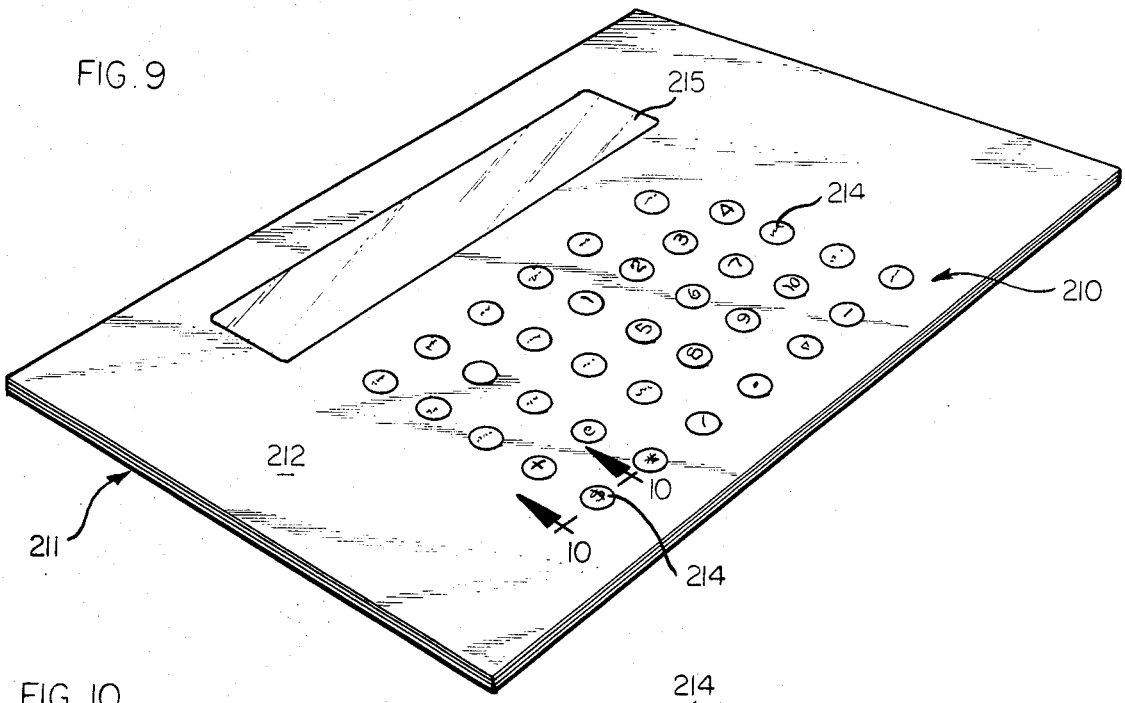
FIG. 9 is a perspective view of a switch keyboard showing a plurality of the improved tactile affirmative response switches of the present invention as set forth in keyboard format and further showing a visual display area disposed at the top portion of such keyboard.
Figure 10:
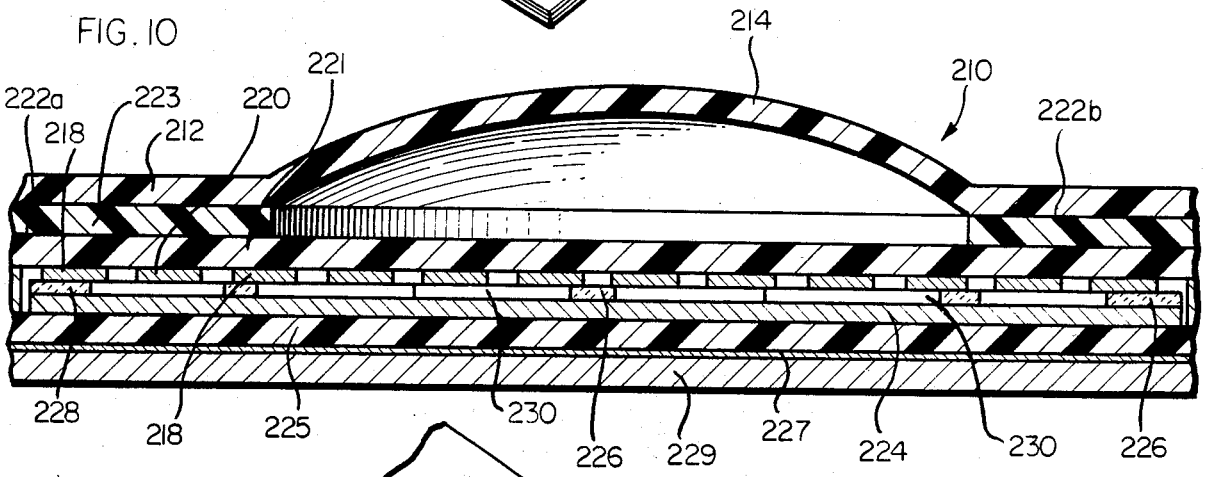
FIG. 10 is a greatly enlarged cross-sectional view of an improved tactile affirmative response switch of the present invention taken along lines 10—10 of FIG. 9, and showing in particular the upwardly disposed dome shaped manually operable portion of the top sheet, disposed atop a spacer sheet, which in turn is disposed above the remaining elements of the switch, as described in the figures, supra.
Figure 11:
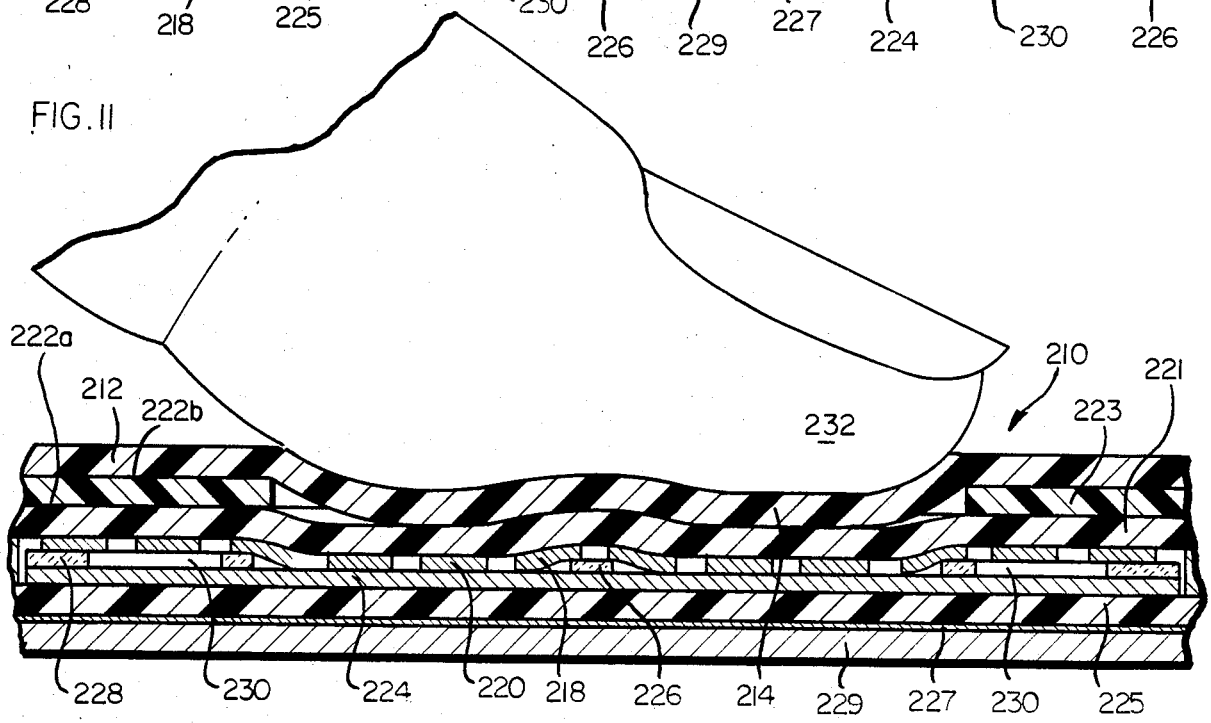
FIG. 11 is also a greatly enlarged sectional view of the embodiment of the present invention as shown in FIG. 10, being actuated by manual pressure.

In the improved tactile affirmative response membrane switch shown in FIGS. 9–11, the switch thereof generally 210 is contained within a switch panel generally 211 having a top sheet 212 with the plurality of domed switch portions 214 disposed thereon in a selected array, such as in a typewriter format for example, to define visual indicia thereon for manual pushing to operate the switch 210. Such keyboard 211 may further include a visual display element 215, which preferably may be disposed at the top portion of switch panel or keyboard 211.

As shown in FIG. 10 in particular, the improved tactile affirmative response switch 210 of the present invention includes a pair of electronic switch circuit leads 218, 220 which are disposed in noncontacting, and mutually relative proximity. Such switch leads 218, 220 are disposed on a polymeric sheet 221, which is in turn secured preferably by a contact adhesive **222*a* to a top sheet spacer 223, which is in turn secured by further contact adhesive 222*b* to top sheet 212**.

A substantially planar circuit completing means 224 has a size and shape to correspond with at least a portion of the pair of switch circuit leads 218, 220. Such circuit completing means 224 is formed from a conductive material, and is disposed in spaced array and substantially parallel to the switch circuit leads 218, 220, as shown in the above Figures. The circuit completing means 224 is disposed on a polymeric sheet 225, which is backed by adhesive 227, which in turn is protected by a peel strip 229 until applied for use to a control panel, etc.

A circuit spacer means 226 of a nonconductive material is disposed between the pair of electronic circuit leads 218, 220, and the circuit completing means 224. Such circuit spacer means 226 may also preferably include a nonconductive border portion 228. The circuit spacer means 226 has a plurality of apertures 230 therein of a selected density sufficient to provide a selective touch pressure for pushing portions of the circuit completing means 224 appearing through the apertures 230 of the circuit spacer means 226 into contact with portions of the pair of electronic switch circuit leads 218, 220 to complete the circuit and to operate switch 210, as shown in FIG. 11 by manual digit 232.

The improved membrane switch of the present invention 210 may specifically include as and for the circuit spacer means 226*a* grid formed from lines of a nonconductive material, as shown in the figures, supra, hereof. Of course, circuit spacer means 226 may take shapes and forms other than a grid. Such nonconductive material for circuit spacer means 226 preferably comprises a nonconductive paint, which is disposed on the circuit completing means, as with the embodiments of FIGS. 1–8. Such circuit completing means 224 preferably comprises a conductive paint material.

The apertures 230 in circuit spacer means 226 may be selected to have varying density and to be disposed in different portions of the nonconductive circuit spacer means 226, to provide a variable touch pressure at different portions of the nonconductive circuit spacer means 226, as shown for example in the embodiments of FIG. 8.

In the operation of switch 210 as shown in FIG. 11, domed switch portion 214 is manually compressed by manual digit 232 to snap the dome thereof downwardly to actuate the switch 210 in the manner described in connection with the embodiments of FIGS. 1–8. Upon release, domed switch portion 214 snaps back to its original position.

Referring now to the embodiments of FIGS. 12–14 in particular, the improved membrane switch of the present invention there designated generally 310 is contained within a switch panel 311 having a top sheet 312 with dome switch portions 314. Top sheet 312 is covered by an overlay sheet 340 having a plurality of upwardly extending manual pad portions 342 which may contain visual indicia thereon for manual pushing to operate the switch 310. Such switch panel 311 may have an electronic connecting means as in the embodiments described, supra.

As shown in FIGS. 12–14, the improved membrane switch 310 of the present invention includes a pair of electronic switch circuit leads 318, 320 which are disposed in noncontacting, and mutually relative proximity. Such switch leads 318, 320 are disposed onto a polymeric sheet 321, which is in turn secured preferably by a contact adhesive 322*a* to top sheet spacer 323, which is in turn secured by further contact adhesive 322*b* to top sheet 312, which in turn is adhesively secured to overlay sheet 340 by means of adhesive layer 344.

A substantially planar circuit completing means 324 has a size and shape to correspond with at least a portion of the pair of switch circuit leads 318, 320. Such circuit completing means 324 is formed from a conductive material, and is disposed in spaced array and substantially parallel to the switch circuit leads 318, 320, as shown in the above Figures. The circuit completing means 324 is disposed on a polymeric sheet 325, which is backed by adhesive 327, which in turn is protected by a peel strip 329 until applied for use to a control panel, etc.

A circuit spacer means 326 of a nonconductive material is disposed between the pair of electronic circuit leads 318, 320, and the circuit completing means 324. Such circuit spacer means 326 may also preferably include a nonconductive border portion 328. The circuit spacer means 326 has a plurality of apertures 330 therein of a selected density sufficient to provide a selective touch pressure for pushing portions of the circuit completing means 324 appearing through the apertures 330 of the circuit spacer means 326 into contact with portions of the pair of electronic switch circuit leads 318, 320 to complete the circuit and to operate switch 310, as shown in FIG. 14 by manual digit 332.

The improved membrane switch of the present invention 310 may specifically include as and for the circuit spacer means 326 a grid formed from lines of a nonconductive material, as shown in the Figures hereof. Of course, circuit spacer means 326 may take shapes and forms other than a grid. Such nonconductive material for circuit spacer means 326 preferably comprises a nonconductive paint, which is disposed on the circuit completing means as shown in the Figures, supra. Such circuit completing means 324 preferably comprises a conductive paint material.

As in the embodiments described above, the apertures 330 in circuit spacer means 326 may be selected to have varying density and to be disposed in different portions of the nonconductive circuit spacer means 326, to provide a variable touch pressure at different portions of the nonconductive circuit spacer means 326, as shown for example in FIG. 8.

In the operation of switch 310 as shown in FIGS. 12–14, the manual pad portion 342 is pushed downwardly by digit 332 which engages domed portion 314 and snaps such domed portion 314 downwardly. Upon release of pad portion 342, domed portion 314 snaps upwardly to its original position. The switch 310 of the embodiments shown in FIGS. 12–14 in other respects operates as do the other embodiments shown in FIGS. 1–11.

Dimensions (in mils.) of the various component layers of several representative embodiments of the present invention are described in the following examples:

COMPARISON OF BASIC KEYBOARD CONSTRUCTIONS

| Example I (Embodiment of FIGS. 1-7) | | Prior Art Tactile Membrane Metal Dome | |
|---|---|---|---|
| Top sheet | .007 | Top sheet | .007 |
| Top adhesive | .002 | Top adhesive | .002 |
| Top circuit | .005 | Top circuit | .005 |
| Top circuit adhesive | .003 | Retainer | .009 |
| Bottom circuit | .005 | Spacer | .003 |
| Bottom adhesive | .002 | Bottom circuit | .005 |
| | | Bottom adhesive | .002 |
| TOTAL | .024 | TOTAL | .033 |

Example II (Embodiment of FIGS. (Embodiment of

-continued

| COMPARISON OF BASIC KEYBOARD CONSTRUCTIONS | | | |
|---|---|---|---|
| 11-13) | | FIGS. 12-14) | |
| Domed top sheet | .007 | Overlay | .007 |
| Top adhesive | .009 | Overlay adhesive | .002 |
| Top circuit | .005 | Domed top sheet | .005 |
| Circuit adhesive | .003 | Top adhesive | .009 |
| Bottom circuit | .005 | Top circuit | .005 |
| Bottom adhesive | .002 | Circuit adhesive | .003 |
| | | Bottom circuit | .005 |
| | | Bottom adhesive | .002 |
| TOTAL | .031 | TOTAL | .038 |

| Example III | | | |
|---|---|---|---|
| Alternative Membrane Switch | | Low Profile Tactile | |
| Overlay | .007 | Overlay | .007 |
| Top adhesive | .002 | Top adhesive | .002 |
| Top circuit | .005 | Retainer | .007 |
| Spacer | .005 | P.C. Board | .062 |
| Bottom circuit | .005 | Vapor barrier | .003 |
| Bottom adhesive | .002 | Bottom adhesive | .002 |
| TOTAL | .026 | TOTAL | .081 |

Various materials have been suitable for making the switches hereof. The domed top sheet has been particularly successfully formed of a polyester material, whereas to date the polycarbonates have lacked the durability required for repeated operations. The use of other materials for the component layers of such switches will become apparent to those of orginary skill in the art upon the review of the teachings hereof.

In the above description, specific details of an embodiment of the invention have been provided for a thorough understanding of the inventive concepts. It will be understood by those skilled in the art that many of these details may be varied without departing from the spirit and scope of the invention.

What is claimed is:

1. An improved tactile affirmative response membrane switch comprising:

a top sheet formed from a nonconductive material, with a portion of said top sheet designated thereon for manual pushing to operate the switch, said portion having an upwardly disposed dome shape, manually operable between two positions and having an upwardly disposed first position when the switch is not operating and is in the "off" position and to affirmatively snap into a downwardly disposed second position when the switch is operated to the "on" position, with said dome portion automatically returning affirmatively and snapping to the first position upon manual release thereof, thereby to provide an affirmative and detectible tactile response thereto;

a pair of electronic switch circuit leads disposed in the same plane in noncontacting mutually relative close proximity, said pair of electronic switch circuit leads each comprising a plurality of intertwined but non-contacting elongated bars, said bars having a designated width;

supporting means for said electronic switch circuit leads;

spacer means disposed between said top sheet and said supporting means, and having an opening therein at the location of said dome shaped portion of said top sheet;

a substantially planar circuit completing means of a size and shape to correspond with at least a portion of said pair of switch circuit leads, formed from conductive material, and disposed in spaced array and substantially parallel to said switch circuit leads; and a nonconductive circuit spacer means comprising a grid, said grid comprising a plurality of substantially intersecting lines of a nonconductive material, said substantially intersecting lines of said grid having a width which is substantially narrow relative to the selected width of said elongated bars of said electronic switch circuit leads, said substantially intersecting lines of said grid disposed directly between said pair of electronic circuit leads and said circuit completing means, said circuit spacer means grid having a plurality of apertures therein formed by said substantially intersecting lines of said grid and having a selected grid density sufficient to provide a selected touch pressure during pushing at least a portion of the said circuit completing means appearing through the apertures in said spacer grid into contact with at least a portion of the pair of electronic switch circuit leads to complete the circuit and to operate the switch.

2. The improved tactile affirmative response switch of claim 1 wherein at least one of said nonconductive materials comprises a nonconductive paint.

3. The improved tactile affirmative response switch of claim 1 wherein said circuit completing means comprises a conductive paint material.

4. The improved tactile affirmative response switch of claim 3 wherein said conductive paint material is disposed upon a backing sheet.

5. The improved tactile affirmative response switch of claim 1 wherein said circuit completing means is disposed upon a backing sheet.

6. The improved tactile affirmative response switch of claim 1 wherein said nonconductive circuit spacer apertures vary in density in different portions of said nonconductive circuit spacer to provide a variable touch pressure at different portions of said nonconductive circuit spacer.

7. The improved tactile affirmative response switch of claim 1 wherein said pair of electronic switch circuit leads are disposed in a common plane.

8. The improved tactile affirmative response switch of claim 1 wherein said electronic switch circuit leads are printed of conductive paint.

9. The improved tactile affirmative response switch of claim 1 wherein the top sheet comprises a nonconductive polymeric overlay containing visual indicia thereon to define the switch portion to be operated by manual pushing.

10. The improved tactile affirmative response switch of claim 1 wherein said supporting means for said electronic switch circuit leads comprise a substantially planar polymeric sheet.

11. The improved tactile affirmative response switch of claim 1 wherein said intertwined elongated bars of said electronic switch circuit leads combine to cover a defined area which is substantially co-extensive with the portions designated on the top sheet for manual pushing to operate the switch.

12. The improved tactile affirmative switch of claim 1 wherein said dome shaped portion is substantially circular in shape.

13. The improved tactile affirmative switch of claim 1 where said dome shaped portion is substantially oblong in shape.

14. The improved tactile affirmative switch of claim 1 where said dome shaped portion is substantially square in shape.

15. The improved tactile affirmative switch of claim 1 where said dome shaped portion is substantially rectangular in shape.

* * * * *